US011447382B2

(12) United States Patent
Karmios

(10) Patent No.: US 11,447,382 B2
(45) Date of Patent: Sep. 20, 2022

(54) PRESSURE EQUALISING PIERCING DEVICE FOR JARS HAVING A SCREW-TOP CLOSURE

(71) Applicant: Pro4UK Limited, Leagrave (GB)

(72) Inventor: Louis Karmios, Leagrave (GB)

(73) Assignee: PRO4UK LIMITED, Leagrave (GB)

( * ) Notice: Subject to any disclaimer, the term of this patent is extended or adjusted under 35 U.S.C. 154(b) by 9 days.

(21) Appl. No.: 17/057,872

(22) PCT Filed: Jun. 6, 2019

(86) PCT No.: PCT/EP2019/064902
§ 371 (c)(1),
(2) Date: Nov. 23, 2020

(87) PCT Pub. No.: WO2019/234205
PCT Pub. Date: Dec. 12, 2019

(65) Prior Publication Data

US 2021/0261396 A1 Aug. 26, 2021

(30) Foreign Application Priority Data

Jun. 6, 2018 (GB) ..... 1809253

(51) Int. Cl.
*B67B 7/00* (2006.01)
*B26F 1/24* (2006.01)
(Continued)

(52) U.S. Cl.
CPC ..... *B67B 7/24* (2013.01); *B26F 1/24* (2013.01); *B26F 1/32* (2013.01); *B67B 7/20* (2013.01)

(58) Field of Classification Search
CPC ..... B26F 1/24; B26F 1/02; B26F 1/12; B26F 1/32; B26F 1/36; B67B 7/20; B67B 7/18; B67B 7/24
See application file for complete search history.

(56) References Cited

U.S. PATENT DOCUMENTS 2,338,592 A * 1/1944 Lorenzen ..... B67B 7/24 30/443
2,390,309 A * 12/1945 Keys ..... B67B 7/24 30/443
(Continued)

FOREIGN PATENT DOCUMENTS

BE 1015199 10/2004
BE 1015849 A 10/2005
(Continued)

OTHER PUBLICATIONS

Combined Search and Examination Report issued for GB1809253.6 dated Dec. 7, 2018.
(Continued)

*Primary Examiner* — Evan H Macfarlane
*Assistant Examiner* — Fernando A Ayala
(74) *Attorney, Agent, or Firm* — Westman, Champlin & Koehler, P.A.; Z. Peter Sawicki; Amanda M. Prose

(57) ABSTRACT

A pressure equalising device (10) which has a squat shape and which has three positions which are a first unlocked and retracted position, a second locked and retracted position, and a third unlocked and extended position wherein the device comprises a spike (14) for piercing a container, a biasing member (12) to bias the device into the first position from the third position, an upper body (20) which supports the spike and which has a locking formation (28), and a lower body (40); wherein the device has a twist lock such that the device can be rotated to and from its first and second positions; wherein the twist lock comprises a slot (52) in the lower body which is positioned to receive the locking formation (28) to immobilise the upper body (20) in relation to the lower body (40); the invention provides an ergonomically acceptable and safe way to reduce the torque force
(Continued)

required to open the typical jar to less that 2 Nm by equalising the pressures inside and outside the jar.

6 Claims, 6 Drawing Sheets

(51) Int. Cl.
*B26F 1/32* (2006.01)
*B67B 7/20* (2006.01)

(56) References Cited

U.S. PATENT DOCUMENTS

| | | | | |
|---|---|---|---|---|
| 2,620,558 | A * | 12/1952 | Bergeron | B67B 7/24 30/443 |
| 2,795,052 | A | 6/1957 | Felenchak | |
| 2,858,721 | A | 11/1958 | Horne | |
| 2,943,389 | A * | 7/1960 | Dubois | B67B 7/24 30/443 |
| 3,411,387 | A | 11/1968 | Bailey | |
| 6,202,876 | B1 | 3/2001 | DeJonge | |
| 6,629,483 | B2 * | 10/2003 | Iwao | B09B 3/0058 30/366 |
| 8,387,264 | B1 * | 3/2013 | Pritchard | B26F 1/32 30/366 |
| 2002/0117040 | A1 | 8/2002 | Iwao | |
| 2006/0042101 | A1 * | 3/2006 | Roefs | B26F 1/32 30/366 |
| 2006/0117577 | A1 * | 6/2006 | King | B26F 1/32 30/368 |
| 2006/0150789 | A1 | 7/2006 | Russell | |
| 2006/0236552 | A1 * | 10/2006 | Giles | B67B 7/18 30/366 |
| 2009/0069783 | A1 * | 3/2009 | Ellstrom | A61J 1/2065 604/415 |
| 2012/0240739 | A1 | 9/2012 | Dunyon et al. | |
| 2014/0224071 | A1 | 8/2014 | Kamakura et al. | |
| 2015/0251330 | A1 | 9/2015 | Garcia | |
| 2018/0334371 | A1 | 11/2018 | Trench et al. | |

FOREIGN PATENT DOCUMENTS

| | | | |
|---|---|---|---|
| CN | 2371177 | Y | 3/2000 |
| CN | 2883309 | Y | 3/2007 |
| CN | 201647960 | U | 11/2010 |
| CN | 201882886 | U | 6/2011 |
| CN | 203807112 | U | 9/2014 |
| FR | 2908758 | A | 5/2008 |
| NL | 1017313 | C | 8/2002 |
| WO | 2006116123 | A1 | 11/2006 |

OTHER PUBLICATIONS

Examination Report issued for GB1809253.6 dated Mar. 19, 2019.
Examination Report issued for GB1809253.6 dated Apr. 3, 2020.
Examination Report issued for GB1809253.6 dated Aug. 26, 2020.
International Search Report issued for PCT/EP2019/064902, dated Sep. 26, 2019.
Written Opinion of the International Searching Authority issued for PCT/EP2019/064902, dated Sep. 26, 2019.

* cited by examiner

PRESSURE EQUALISING PIERCING DEVICE FOR JARS HAVING A SCREW-TOP CLOSURE

CROSS-REFERENCE TO RELATED APPLICATION

This Application is a Section 371 National Stage Application of International Application No. PCT/EP2019/064902, filed Jun. 6, 2019 and published as WO 2019/234205 A1 on Dec. 12, 2019, in English, which claims priority to GB patent application Serial No. 1809253.6, filed Jun. 6, 2018, the contents of which are hereby incorporated by reference in their entirety.

The present invention relates to a pressure equalising device for use with a jar having a screw-top closure.

Jars which have a screw-top lid and which are used to store foodstuffs such as jams, pickles, and sauces have an internal pressure which is less that atmospheric pressure, commonly referred to as a "vacuum". Typically, this lower internal pressure is formed by the jars being filled and closed by the screw-top lid when their contents are hot such that the jar internal air space between the jar contents and the screw-top lid is mostly steam. When the steam condenses as the contents cools, the internal pressure in the jar internal air space drops. As a result of the pressure drop, there is a load or pressure acting on the outside surface of the lid which can make it hard for a person to unscrew the lid. Generally speaking, the larger the lid diameter, the greater the torque force required to remove it. Investigations have found that most jars require more than 4 Nm of torque force to remove a screw-top lid, typically from 4 to 12 Nm.

People with less mobility struggle to open such jars with screw-top lids and could conceivably strain or injure their wrists by opening jars requiring more than 4 Nm of torque force to open. The average person cannot produce more than 4 Nm of torque force with their bare hands. This figure reduces with age and disability. Studies have found that if opening torque was reduced to 2 N m then 97.6% of users between 50 and 94 years of age and 100% of 20-30 year old users would have no difficulty opening a jar (Voorbij A I, Steenbekkers L P: "The twisting force of aged consumers when opening a jar." Appl Ergon. 2002 January; 33(1):105-9).

A way of ameliorating these problems has been sought.

According to the invention there is provided a pressure equalising device which has a squat shape and which has three positions which are a first unlocked and retracted position, a second locked and retracted position, and a third unlocked and extended position wherein the device comprises a spike for piercing a container to increase its internal pressure, a biasing member to bias the device into the first position from the third position, an upper body which supports the spike and which has a locking formation, and a lower body; wherein the device has a twist lock such that the device can be rotated to and from its first and second positions; wherein the twist lock comprises a slot in the lower body which is positioned to receive the locking formation to immobilise the upper body in relation to the lower body.

Advantages of the invention include that it is an ergonomically acceptable and safe way to reduce the torque force required to open the typical jar to less that 2 Nm by equalising the pressures inside and outside the jar. Our research has found that a specimen jar lid required on average 4.494 Nm of torque force to remove. By using our device to equalise the inside and outside pressures, the specimen jar lid required just 0.839 Nm torque force which should be within the capabilities of the majority of people with reduced mobility. Represented as a percentage; use of our device reduces the amount of torque force required to open the average specimen jar by over 81%. In other words, a person using the device according to the invention only needs to apply 19% of the torque force usually required to open the specimen jar without the use of our device.

In some embodiments, the spike may be fully withdrawn into the upper body in the first or second positions. Advantages of having a fully withdrawn spike in these positions is that the spike cannot cause any harm or damage when the device is not in use.

In some embodiments, the device may have a cylindrical shape. In some embodiments, the pressure equalising device may have a squat shape wherein the ratio of its diameter to its height is from 1.2:1 to 1:1.2.

In some embodiments, the upper body may have an upper body wall which forms an external surface for the device. In some embodiments, the upper body wall may have an upper body wall rim along its lower edge which forms an opposing pair of notches for indicating whether the pressure equalising device is in its second locked position or first/third unlocked position. In some embodiments, the locking formations may be provided on an inner surface of the upper body wall.

In some embodiments, the locking formations may be in the form of horizontal inwardly-extending arcuate ridges. In some embodiments, the locking formations may have a rectilinear cross-section, such as a square or rectangular cross-sectional shape. In some embodiments, the upper body wall locking formations are arranged at a pre-determined height from the upper body wall rim.

In some embodiments, the upper body may have an upper body grip for operating the device, e.g. to move it from its first position to its third position.

In some embodiments, the upper body may have a spike support. In some embodiments, the spike support may have a plurality of spike support ribs to guide and support the biasing member. In some embodiments, the spike support may form a vertical spike aperture in which the spike may be fixed, for example by gluing or by bonding during moulding of the upper body. In some embodiments, the biasing member may be a spring.

In some embodiments, the lower body has a base. In some embodiments, the base may have a base peripheral ridge for engaging with the container to be pierced. In some embodiments, the base peripheral ridge may be formed from a resilient material to reduce the risk of the device slipping on the container. In some embodiments, the base may have a base step for supporting a lower body outer wall. In some embodiments, the base may have a dome-shaped formation which forms a base aperture through which the spike extends in the third position.

In some embodiments, the lower body has an inner wall to support the biasing member. In some embodiments, the inner wall may have a cylindrical shape.

In some embodiments, the lower body has an outer wall. In some embodiments, the outer wall has an outer wall locked indicator and an outer wall unlocked indicator, e.g. on its lower end.

In some embodiments, the outer wall forms an outer wall cut out in which is provided a lower body clip for engaging a locking formation. In some embodiments, the outer wall forms at least two opposing outer wall cut outs.

In some embodiments, the lower body has an outer wall which forms an outer wall cut out and the slot is formed in the outer wall at an edge of the outer wall cut out. In some embodiments, the slot is formed in the outer wall at a clockwise side of the outer wall cut out. In some embodiments, the slot may have a narrow slot entrance and a slot ramp to reduce the risk of the device being moved from its second locked position to its first unlocked position accidentally. In some embodiments, the outer wall slot has an arcuate length which is at least the same as an arcuate length of the locking formation.

In some embodiments, the slot may have a limited height such that the upper body cannot be substantially moved vertically in relation to the lower body, e.g. such that the spike cannot be extended from the upper body. In some embodiments, the lower body may have a lower body clip and the slot may have a slot entrance which has an upper end which is arranged to be at substantially the same level as the lower body clip. The advantage of this feature is that it allows the upper body to be rotated in relation to the lower body to and from the first and second positions of the device.

In some embodiments, the slot may have a slot ramp to provide resistance to movement of the device from its second position to its first position. The advantage of this feature is that it reduces the risk that the device may be accidentally unlocked. In some embodiments, the slot ramp may taper the height of the slot.

In some embodiments, the outer wall cut out may have an arcuate length which is slightly greater than the arcuate length of the locking formations. The advantage of this feature is that the locking formations can be moved through the cut outs to engage the locking clips such that the lower body clips resiliently attach the lower body to the upper body.

In some embodiments, the lower body clip may have a lower body clip hook which is shaped to engage with the locking formation. In some embodiments, the lower body clip may have a catch.

The invention will now be illustrated with reference to the following Figures of the accompanying drawings which are not intended to limit the scope of the claimed invention:

Figure 1:
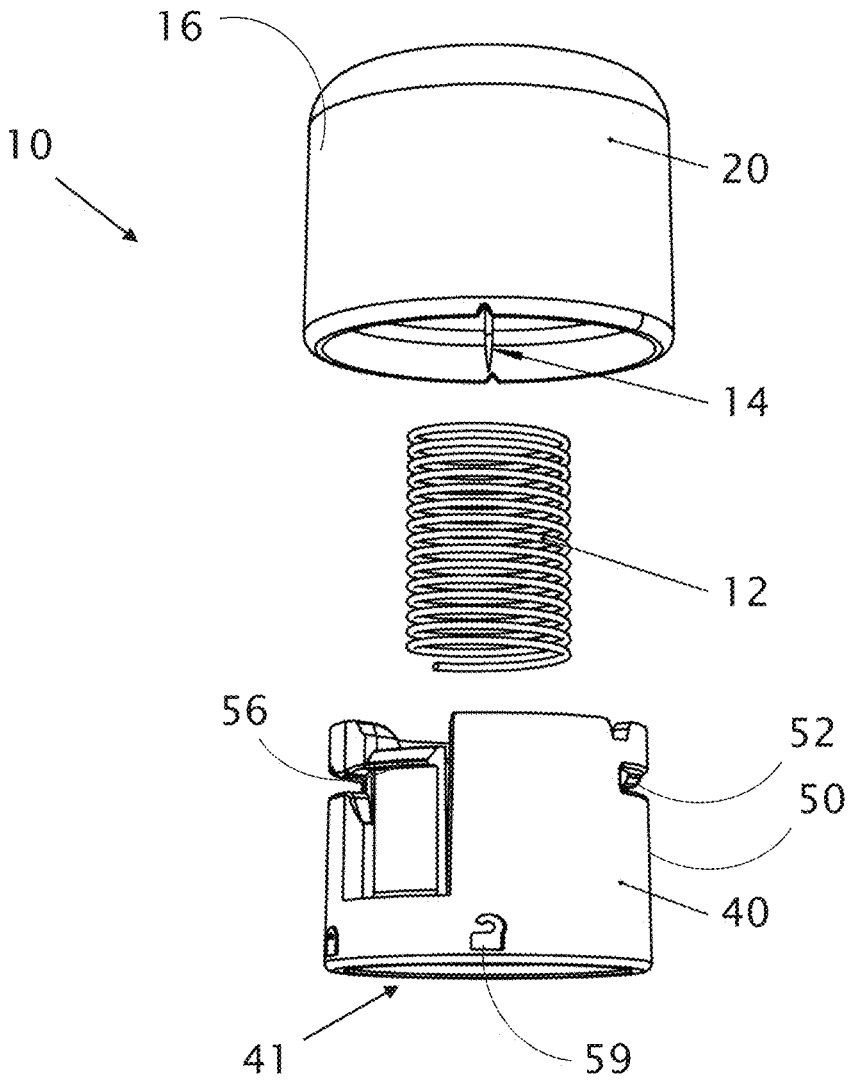
FIG. 1 shows a schematic exploded perspective view of the pressure equalising device according to the invention.

A pressure equalising device according to the invention is indicated generally at 10 on FIG. 1 of the accompanying drawings. Pressure equalising device 10 has a cylindrical squat shape with a diameter which is approximately the same as its height. Pressure equalising device 10 has three positions which are a first unlocked and retracted position, a second locked and retracted position, and a third unlocked and extended position. Thus, the pressure equalising device 10 may be locked in a retracted position for safety. Pressure equalising device 10 comprises a biasing member 12 to bias the device 10 into its first position from the third position, a spike 14 which is extended in the third position, an upper body 20 which supports the spike, and a lower body 40 which may be locked relative to the upper body 20 in the second position. The device 10 may be formed by moulding a resilient plastics material. Biasing member 12 may be in the form of a spring.

Figure 4:
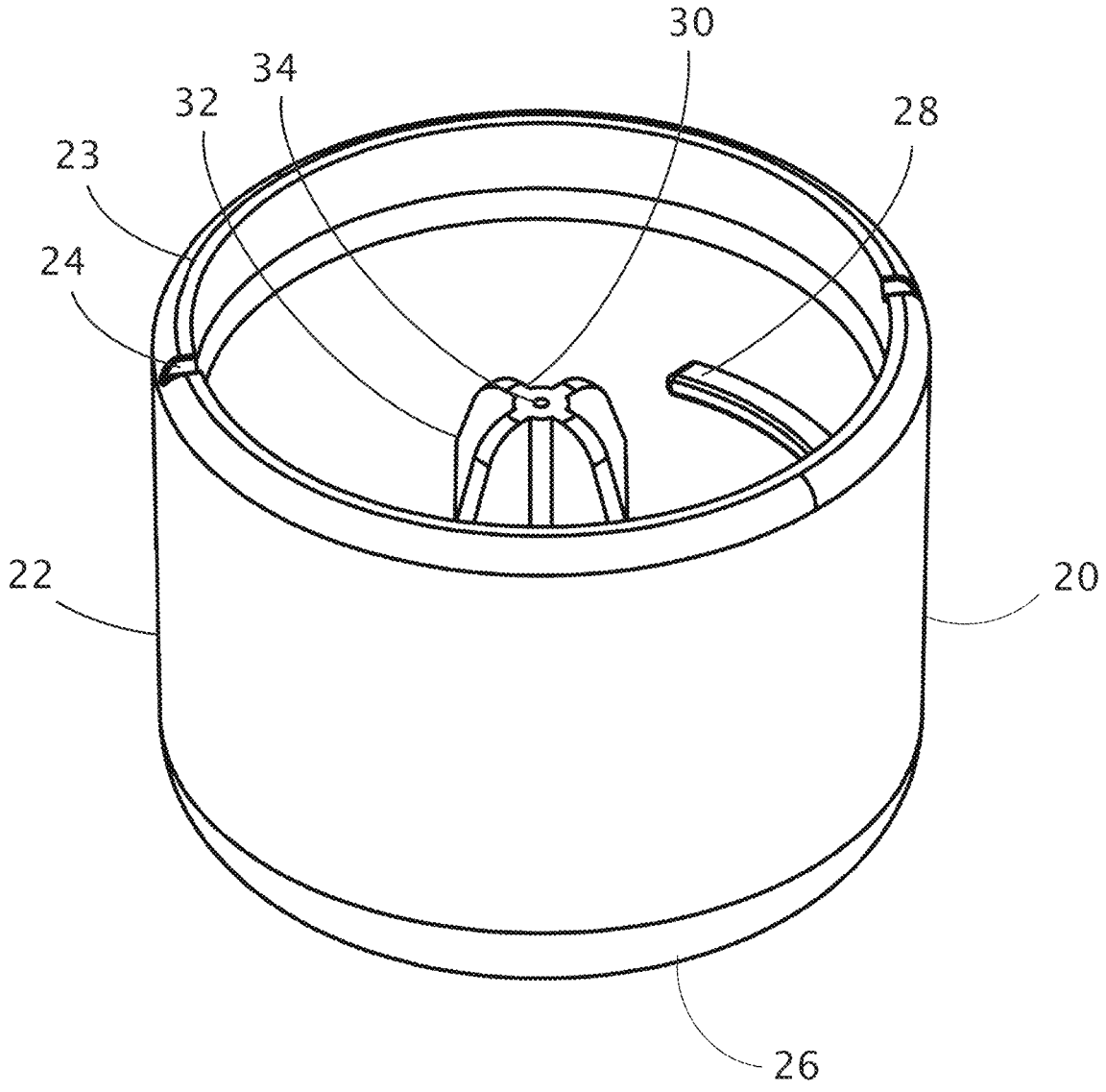
FIG. 4 shows a schematic perspective view of an inverted upper body of the pressure equalising device shown in FIG. 1.
Figure 5:
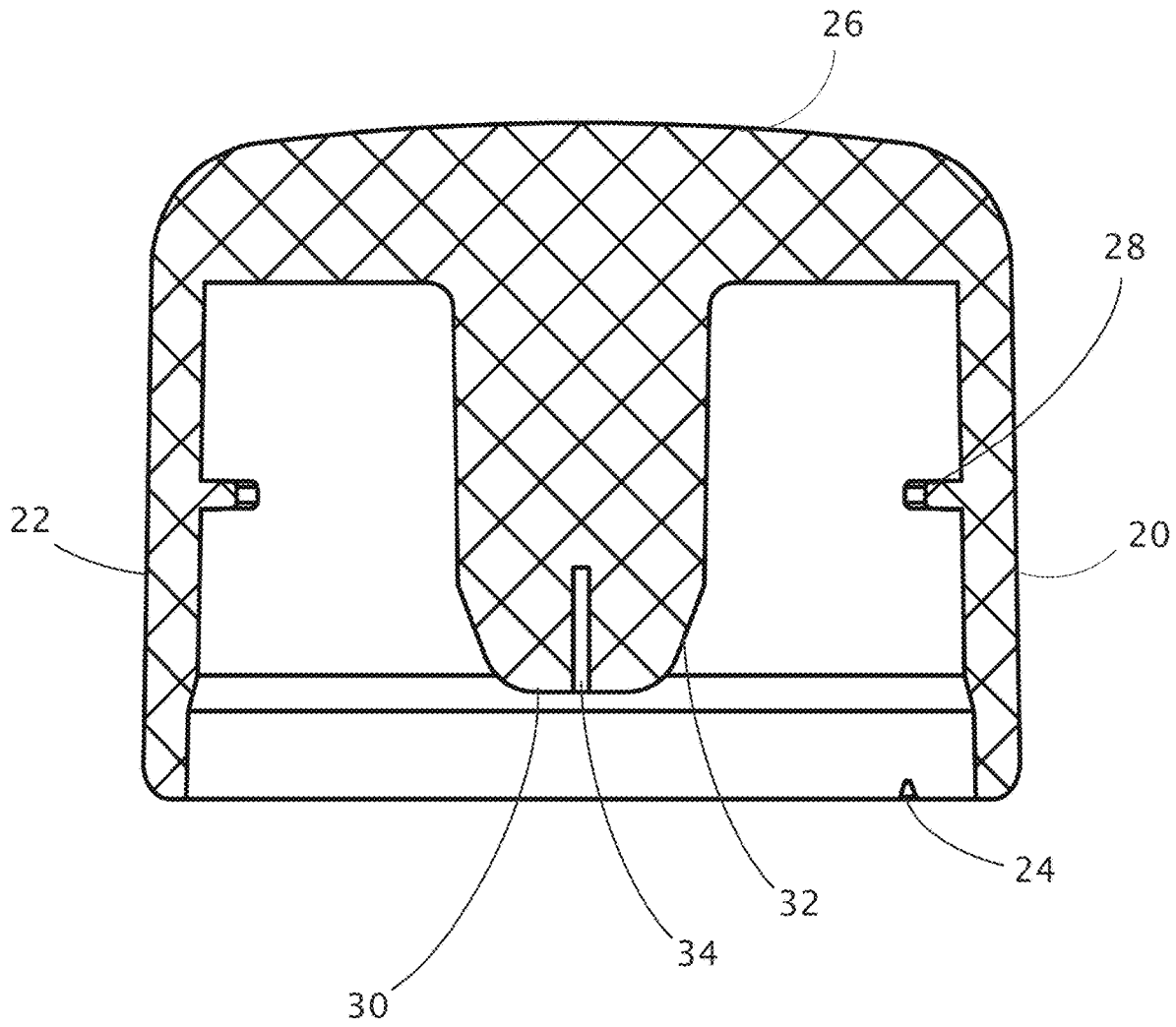
FIG. 5 shows a schematic vertical cross-sectional view of the upper body of the pressure equalising device shown in FIG. 4.
Figure 6:
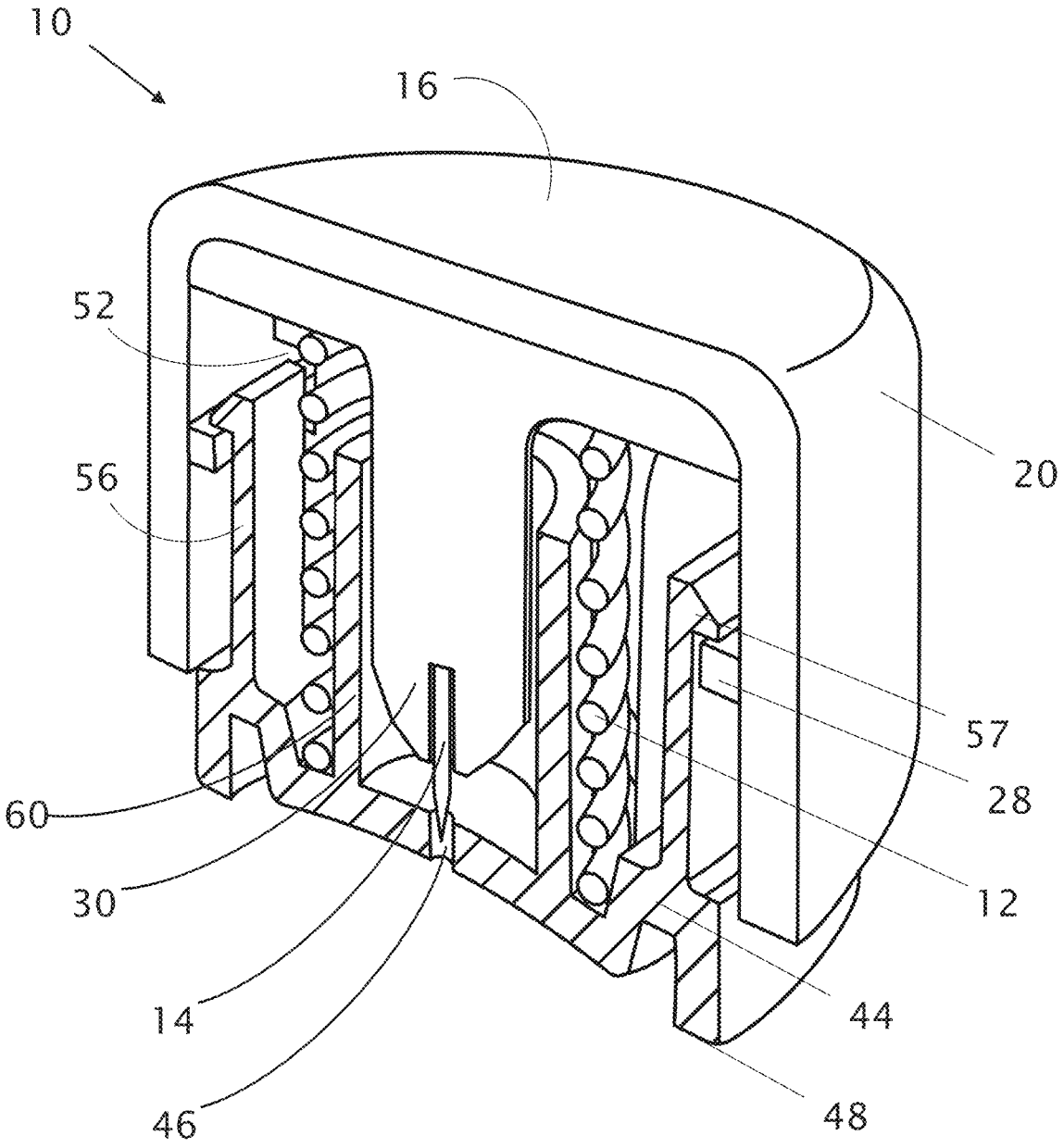

Upper body 20 is illustrated in more detail in FIGS. 4 and 5. Upper body 20 has an upper body wall 22 which forms an external surface for the device 10, an upper body grip 26 for operating the device 10 by moving it from its first position to its third position, and a spike support 30. Upper body wall 22 has an upper body wall rim 23 along its lower edge which forms an opposing pair of notches 24 for indicating whether the pressure equalising device 10 is in a locked or unlocked position. On an inner surface of upper body wall 22 a pair of opposing upper body wall locking formations 28 are formed. Upper body wall locking formations 28 are in the form of horizontal inwardly-extending arcuate ridges which have a rectangular cross-section. The upper body wall locking formations 28 are arranged at a height from the upper body wall rim 23. Spike support 30 has four spike support ribs 32 which are arranged in the form of a cross around the support 30 and which guide and support the biasing member 12. Spike support 30 forms a vertical spike aperture 34 in which spike 14 may be fixed by gluing. Alternatively, spike 14 may be fixed by being bonded to the vertical spike aperture 34 during the formation of the upper body 20 by plastics moulding.

Figure 2:
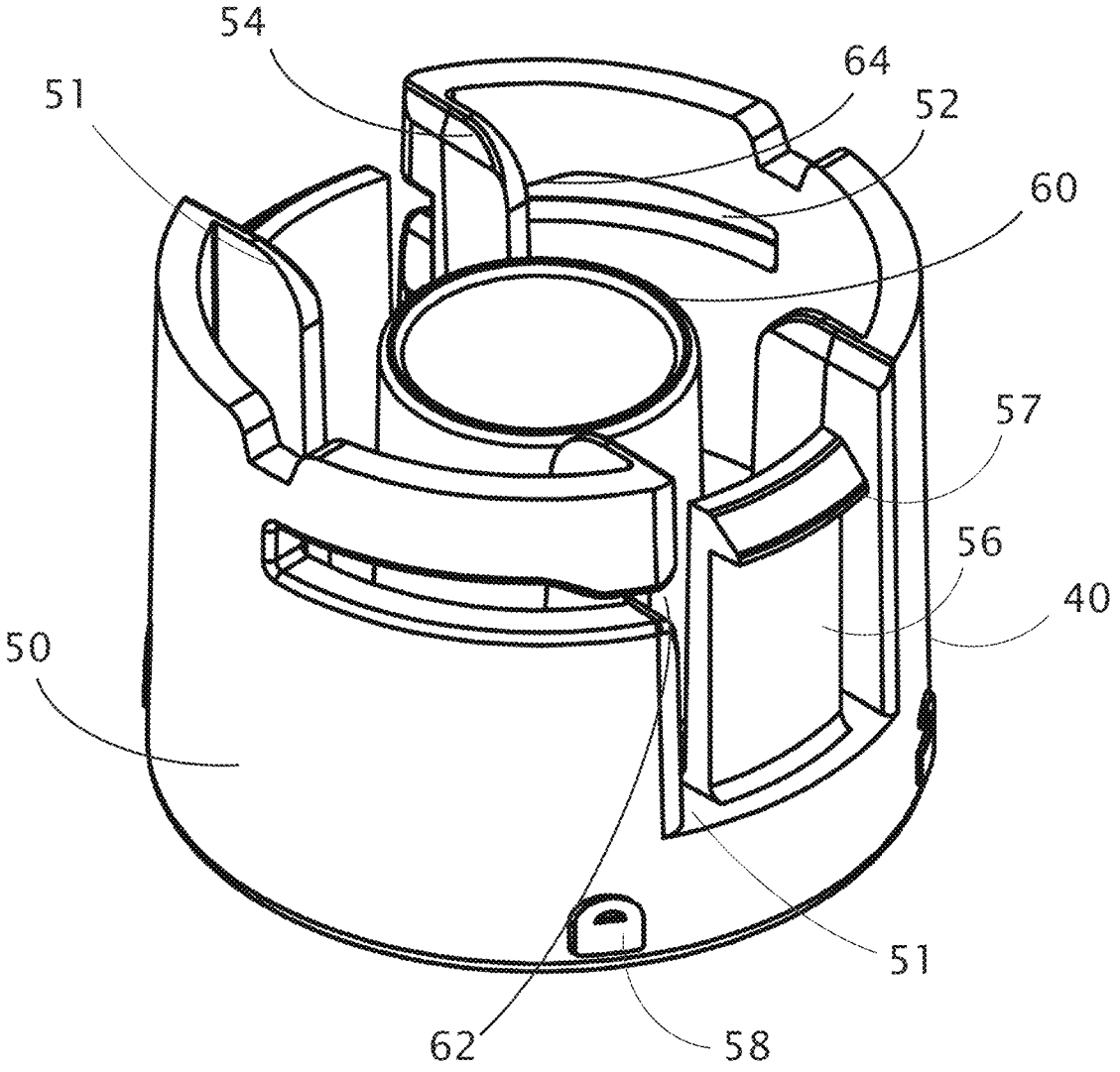
FIG. 2 shows a schematic perspective view of a lower body of the pressure equalising device shown in FIG. 1.
Figure 3:
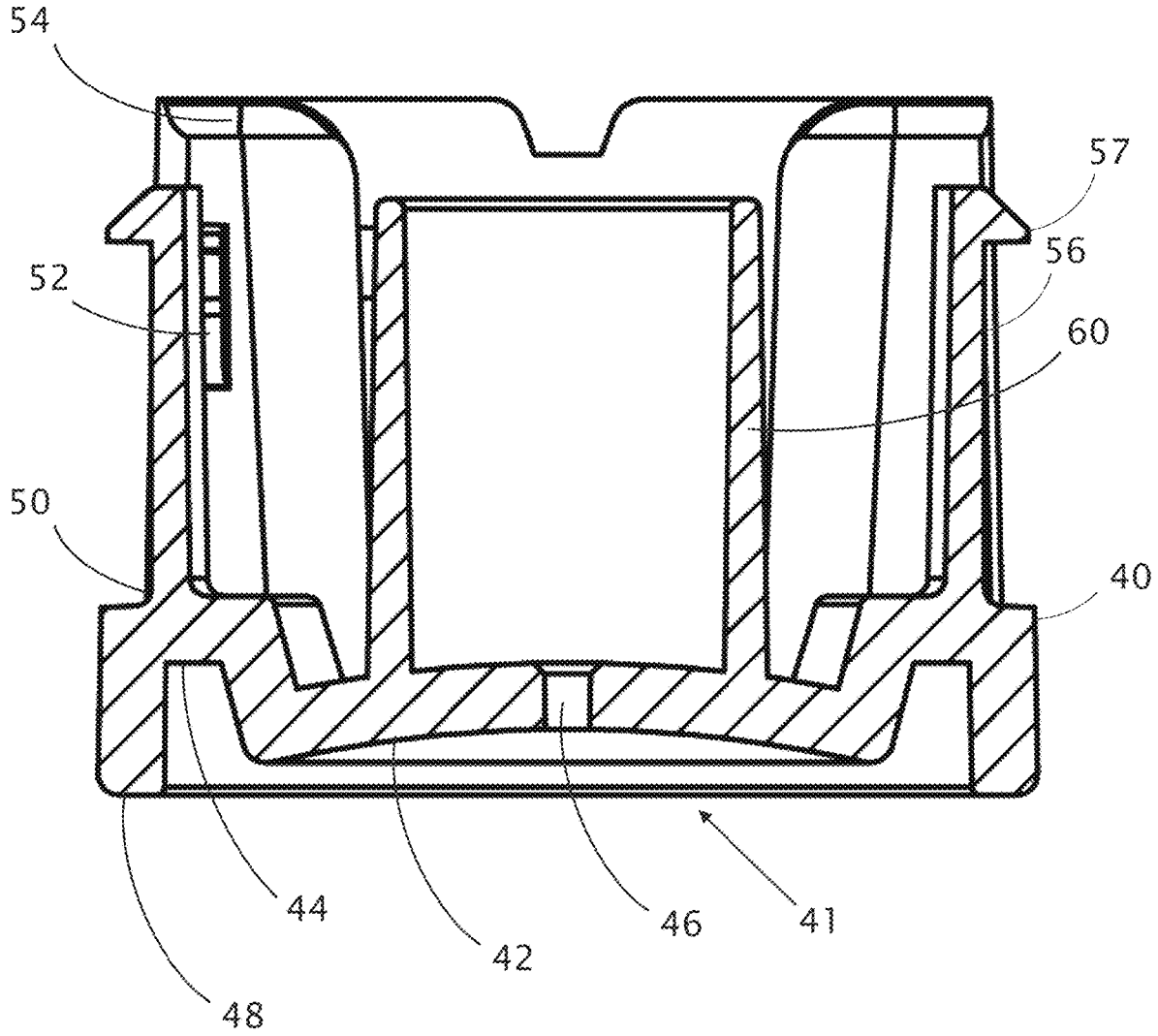
FIG. 3 shows a schematic vertical cross-sectional view of the lower body of the pressure equalising device shown in FIG. 2.

Lower body 40 is illustrated in more detail in FIGS. 2 and 3. It has a base indicated at 41, an inner wall 60 and an outer wall 50 which has a first height above base 41. Inner wall 60 has a cylindrical shape such that its outer surface supports biasing member 12. Inner wall 60 receives spike support 30.

Base 41 has a base peripheral ridge 48, a base step 44, a dome-shaped formation 42, and a base aperture 34. The base peripheral ridge 48 is for engaging with the lid of the container to be pierced. The base peripheral ridge 48 may be formed from a resilient material to reduce the risk of the device 10 slipping on the lid. The base step 44 forms a support for the outer wall 50 and connects the base peripheral ridge 48 to the dome-shaped formation 42. The dome-shaped formation 42 forms a support for inner wall 60 and forms the base aperture 34 through which the spike 14 extends when the device 10 is in its third position when it is operated to pierce the lid of a container.

The outer wall 50 forms the external surface of the lower body 40. Outer wall 50 forms an outer wall locked indicator 58 and an outer wall unlocked indicator 59 on its lower end which is proximal to base peripheral ridge 48. When the device 10 is in its first position or third position, the upper body wall notch 24 is aligned with outer wall unlocked indicator 59. When the device 10 is in its second position, the upper body wall notch 24 is rotated to be aligned with outer wall locked indicator 58. Outer wall locked indicator 58 is in the shape of a locked padlock whereas outer wall unlocked indicator 59 is in the shape of an unlocked padlock though other shapes can be used to indicate the position of the device 10. The outer wall 50 forms an opposing pair of outer wall cut outs 51. At the clockwise side of each outer wall cut out 51, the outer wall 50 forms an outer wall slot 52 which has a narrow slot entrance 62 and a slot ramp 64. Each outer wall slot 52 has an arcuate length which is at least the same as the arcuate length of the upper body wall locking formations 28.

In outer wall cut outs 51 are arranged an opposing pair of lower body clips 56. The arcuate length of the outer wall cut outs 51 is slightly greater than the arcuate length of the upper body wall locking formations 28 such that the formations 28 can be moved through the cut outs 51 to engage the clips 56 such that lower body clips 56 resiliently attach the lower body 40 to the upper body 20. Lower body clips 56 each have a lower body clip hook 57 which is shaped to engage with an upper body wall locking formation 28. The lower body clip hooks 57 have a triangular cross-section such that they are in the form of a catch which slopes downwards from an upper end of the lower body clip 56 to slidingly engage with an upper body wall locking formation 28. Lower body clips 56 have a second height above base 41 which is less than the first height. The second height is arranged to be greater than the height of the upper body wall locking formations 28 above upper body wall rim 23 such that the lower body 40 extends below the upper body 20 and that base peripheral ridge 48 is sufficiently spaced from upper body wall rim 23 that the indicators 58,59 are visible in the first position of device 10.

Outer wall slot 52 is shaped to lock the device 10 in the second position by immobilising the upper body 20 in relation to the lower body 40. The outer wall slot 52 has a limited height such that the upper body 20 cannot be substantially moved vertically in relation to the lower body 40 such that the spike 14 cannot be extended. The upper end of slot entrance 62 is arranged to be at substantially the same level as lower body clip hook 57 such that when the upper body 20 is rotated clockwise in relation to the lower body 40, each upper body locking formation 28 enters each outer wall slot 52. The height of each outer wall slot 52 is tapered by slot ramp 64 such that slot ramp 64 provides resistance to any anti-clockwise rotational movement of the upper body 20 in relation to the lower body 40 to unlock the device 10 and to return it to its first position so as to reduce the risk that the device 10 may be accidentally unlocked. The outer wall slot 52 and the upper body locking formation 28 provide the device 10 with a twist lock which enables the device 10 to be moved to and from the first and second positions by a twisting or rotational movement of the upper body 20 in relation to the lower body 40.

The invention will now be illustrated with reference to the following Example which is not intended to limit the scope of the claimed invention.

EXAMPLE

The torque force required to open 450 g jars of Maribel Thin Marmalade having a lid with a diameter of 80 mm was measured using a Mark-10 (USA) Cap Torque Tester MTT01-100.

TABLE

| | Force/Nm PIERCED Yes/No | |
|---|---|---|
| Sample | Yes | No |
| 1 | | 3.935 |
| 2 | | 3.990 |
| 3 | | 4.820 |
| 4 | | 5.410 |
| 5 | 1.295 | |
| 6 | | 4.015 |
| 7 | 1.220 | |
| 8 | | 4.020 |
| 9 | 0.995 | |

TABLE-continued

| | Force/Nm PIERCED Yes/No | |
|---|---|---|
| Sample | Yes | No |
| 10 | | 4.300 |
| 11 | 0.355 | |
| 12 | | 5.825 |
| 13 | 0.390 | |
| 14 | | 4.600 |
| 15 | 0.495 | |
| 16 | | 4.020 |
| 17 | 1.120 | |
| AVERAGE | 0.839 | 4.494 |

The results show that the average torque force required to open the 450 g jars of marmalade was 4.494 Nm when the jars were not pierced. After the jars had been pierced using the pressure equalising device according to the invention, the average torque force was reduced to 0.839 Nm which is well within the capabilities of a person with reduced mobility.

The invention claimed is:

1. A pressure equalising device which has a shape where the device is wider than the device is tall and which has three positions which are a first unlocked and retracted position, a second locked and retracted position, and a third unlocked and extended position wherein the device comprises a spike for piercing a container to increase an internal pressure of the container, a biasing member to provide a force to bias the device into the first position from the third position, an upper body which supports the spike and which has a locking formation, and a lower body; wherein the device has a twist lock such that the device can be rotated to and from its first and second positions; wherein the twist lock comprises a slot in the lower body which is positioned to receive the locking formation to immobilise the upper body in relation to the lower body; wherein lower body has an outer wall; wherein the outer wall forms an outer wall cut out in which is provided a lower body clip for engaging the locking formation; wherein the slot has a slot entrance which has an upper end which is arranged to be at substantially the same level as the lower body clip; wherein the lower body clip has a lower body clip hook which is shaped to engage with the locking formation.

2. The device as defined in claim 1 wherein the slot has a slot entrance and a slot ramp to reduce the risk of the device being moved from the second locked position to the first unlocked position accidentally.

3. The device as defined in claim 1 wherein the locking formation is in the form of an arcuate ridge.

4. The device as defined in claim 1 wherein the upper body has a spike support with a plurality of spike support ribs to guide and support the biasing member.

5. The device as defined in claim 1 wherein the lower body has a base having a base peripheral ridge for engaging with a container to be pierced.

6. The device as defined in claim 1 wherein the base has a round-shaped formation which forms a base aperture through which the spike extends in the third position.

* * * * *